US009346309B2

(12) United States Patent
Harris

(10) Patent No.: US 9,346,309 B2
(45) Date of Patent: May 24, 2016

(54) COMPONENT WITH DISPLAY STAND

(71) Applicant: Richard H. Harris, Xenia, OH (US)

(72) Inventor: Richard H. Harris, Xenia, OH (US)

(73) Assignee: ACCO BRANDS CORPORATION, Lake Zurich, IL (US)

( * ) Notice: Subject to any disclaimer, the term of this patent is extended or adjusted under 35 U.S.C. 154(b) by 267 days.

(21) Appl. No.: 13/974,783

(22) Filed: Aug. 23, 2013

(65) Prior Publication Data

US 2015/0054273 A1 Feb. 26, 2015

(51) Int. Cl.

| | |
|---|---|
| ***B42D 3/18*** | (2006.01) |
| ***B42D 3/06*** | (2006.01) |
| ***B42F 7/04*** | (2006.01) |
| *B42D 9/00* | (2006.01) |

(52) U.S. Cl.
CPC ... *B42D 3/06* (2013.01); *B42F 7/04* (2013.01); *B42D 9/00* (2013.01); *B42P 2241/12* (2013.01)

(58) Field of Classification Search
USPC ..... 248/459, 174, 447, 456; 281/33; 206/45.24; 402/4
See application file for complete search history.

(56) References Cited

U.S. PATENT DOCUMENTS

| | | | | |
|---|---|---|---|---|
| 3,366,359 | A | 1/1968 | Wolf et al. | |
| 4,308,951 | A * | 1/1982 | Walker, Jr. | 206/214 |
| 4,318,471 | A * | 3/1982 | Hutton | 206/214 |
| 4,544,123 | A * | 10/1985 | Peacock | 248/460 |
| 4,674,724 | A * | 6/1987 | Gaudet | 248/459 |
| 4,943,177 | A * | 7/1990 | Jordan et al. | 402/72 |
| 6,010,158 | A * | 1/2000 | Croteau | 281/33 |
| 6,213,439 | B1 * | 4/2001 | Giulie et al. | 248/459 |
| 7,178,778 | B2 | 2/2007 | Lee | |
| 7,545,634 | B2 | 6/2009 | Simonian et al. | |
| 7,828,260 | B2 * | 11/2010 | Hauser et al. | 248/456 |
| 8,360,384 | B2 * | 1/2013 | Farris-Gilbert et al. | 248/459 |
| 8,424,829 | B2 * | 4/2013 | Lu et al. | 248/371 |
| 8,485,557 | B2 * | 7/2013 | Zarley | 281/33 |
| 8,550,501 | B2 * | 10/2013 | Pyeon et al. | 281/33 |
| 8,567,740 | B2 * | 10/2013 | Tarnutzer et al. | 248/456 |
| 8,607,976 | B2 * | 12/2013 | Wu et al. | 206/320 |
| 8,763,795 | B1 * | 7/2014 | Oten et al. | 206/45.23 |
| 8,878,637 | B2 * | 11/2014 | Sartee et al. | 335/219 |
| 8,919,544 | B2 * | 12/2014 | Lee | 206/45.24 |
| 8,925,722 | B2 * | 1/2015 | Poon et al. | 206/320 |
| 2003/0019996 | A1 * | 1/2003 | Shields | 248/454 |
| 2008/0230672 | A1 * | 9/2008 | Pachowski | 248/453 |
| 2009/0277058 | A1 * | 11/2009 | Dukes | 40/533 |
| 2009/0289166 | A1 * | 11/2009 | Hopfer | 248/456 |
| 2010/0187803 | A1 * | 7/2010 | Park | 281/33 |
| 2011/0180682 | A1 * | 7/2011 | Tarnutzer et al. | 248/447 |
| 2012/0318950 | A1 * | 12/2012 | Wilber | 248/459 |
| 2013/0213825 | A1 | 8/2013 | Blume et al. | |
| 2014/0291977 | A1 * | 10/2014 | Harris et al. | 281/45 |

(Continued)

FOREIGN PATENT DOCUMENTS

| | | |
|---|---|---|
| WO | 2005/020752 | 3/2005 |

*Primary Examiner* — Bradley Duckworth
(74) *Attorney, Agent, or Firm* — Thompson Hine LLP

(57) ABSTRACT

A component including a generally flat, planar base panel and a stand movably coupled to the base panel, wherein the stand is movable to an extended position wherein the stand is generally not positioned on or above/below the base panel. The stand includes first and second portions pivotally connected together. When the stand is in the extended position the stand is movable to a propped configuration wherein the first and second portions form an angle therebetween to define a display surface at least part of which is positioned at an angle relative to the base panel.

27 Claims, 6 Drawing Sheets

(56) References Cited

U.S. PATENT DOCUMENTS

2014/0347814 A1* 11/2014 Zaloom ..... 361/679.56
2015/0027912 A1* 1/2015 Liu ..... 206/45.24
2015/0054273 A1* 2/2015 Harris ..... 281/29
2015/0174946 A1* 6/2015 Pankow et al. ..... 248/459

* cited by examiner

COMPONENT WITH DISPLAY STAND

The present invention is directed to a component including a display panel for propping another component.

BACKGROUND

Various components, such as folders, portfolios, notebooks, binders, pocket binders and the like can be used to store papers and other loose items. Such components can often be laid flat on a surface such as a desktop, countertop or the like. It is often desired to use such component in conjunction with another component. However, in many cases it can be difficult to view and/or access both components simultaneously.

SUMMARY

Accordingly, in one embodiment the present invention is a component with a display stand which can support/prop another component thereon such that the supported/propped component can be viewed, displayed or the like. More particularly, in one embodiment the invention is a component including a generally flat, planar base panel and a stand movably coupled to the base panel, wherein the stand is movable to an extended position wherein the stand is generally not positioned on or above/below the base panel. The stand includes first and second portions pivotally connected together. When the stand is in the extended position the stand is movable to a propped configuration wherein the first and second portions form an angle therebetween to define a display surface at least part of which is positioned at an angle relative to the base panel.

DETAILED DESCRIPTION

Figure 1:
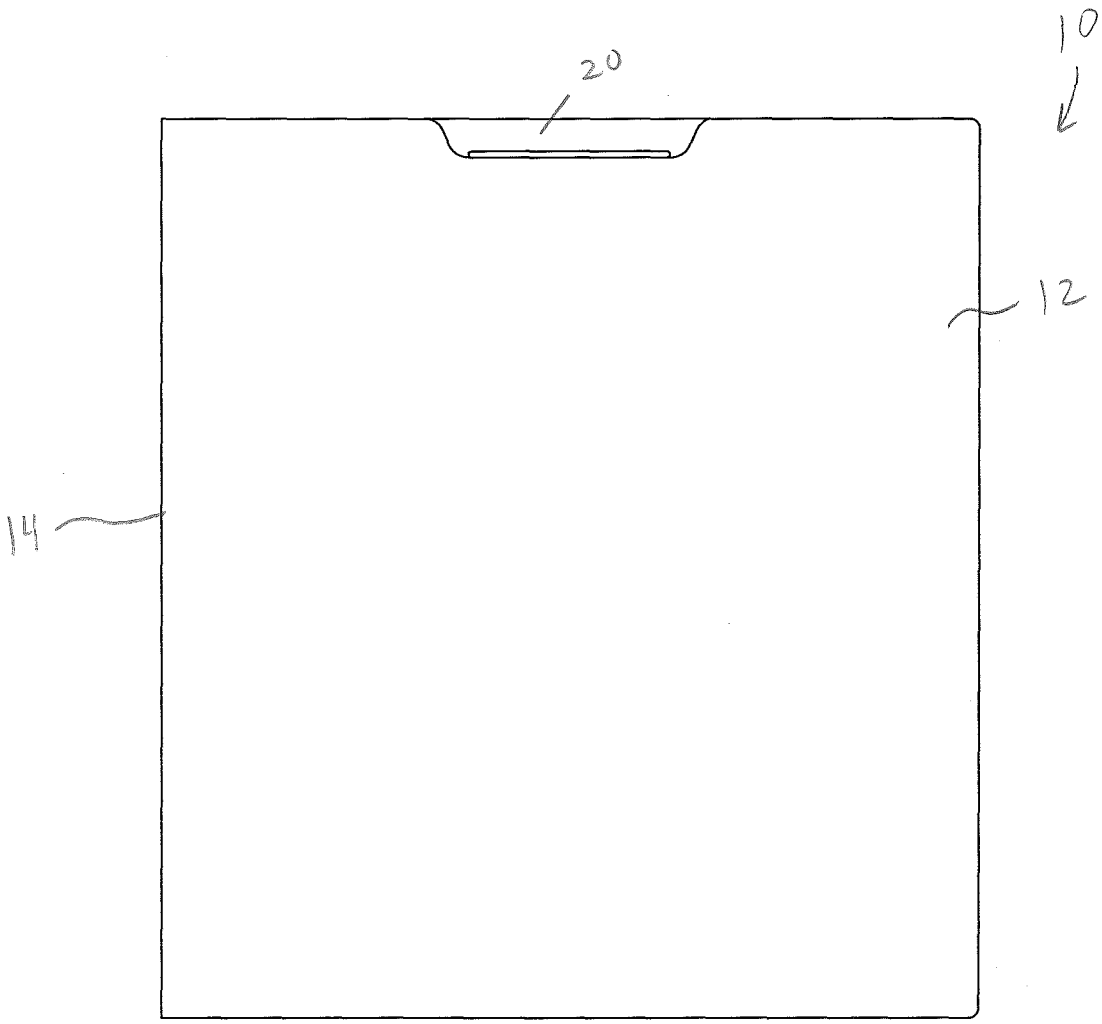
FIG. 1 is a plan view of one embodiment of the component of the present invention, shown in its closed position.

As shown in FIGS. 1-6, in one embodiment the component 10 of the present invention takes the form of a folder, portfolio, notebook, binder, pocket binder or the like having a pair of opposed base panels 12, 13 pivotally attached along a spine or fold line 14. However, the component 10 can take a variety of forms and shaped beyond those specifically shown herein, and need not necessarily be one of the specific devices listed above. Moreover, in some embodiments the component 10 may include only a single base panel 12. In the illustrated embodiment, the base panel 13 has a pocket panel 16 thereon defining a pocket 18 with the underlying base panel 13 such that papers and other loose items can be received in the pocket 18.

Each of the base panels 12, 13 may be generally flat and planar, and generally rectangular in top or plan view. The component 10 is shown in FIG. 1 in its closed position, wherein the base panels 12, 13 are generally parallel, overlapping and facing each other, blocking access to the pocket 18. The component 10 is moveable, by pivoting one or both base panels 12, 13 about the fold line 14, to its open position, shown in FIG. 2, wherein the base panels 12, 13 are parallel, generally co-planar and in a side-by-side configuration, providing access to the pocket 18.

The component 10 can include a stand 20 moveably coupled to the base panel 12. In the illustrated embodiment, the stand 20 is slideably coupled to the base panel 12, and is moveable between a retracted position (FIG. 2), wherein the stand 20 is generally positioned on or directly above/below the base panel 12 in a direction perpendicular thereto, and an extended position wherein the stand 20 is positioned laterally adjacent to, but generally not positioned on or directly above/below the base panel 12 in a direction perpendicular thereto (FIG. 3). The stand 20 in FIGS. 2 and 3 (e.g. when the stand 20 is in either its extended or retracted positions) can be positioned in a generally flat configuration, wherein the stand 20 is generally flat and generally co-planar with the base panel 12.

In one embodiment, the component 10 includes a cover panel 22 having generally the same size and shape as the base panel 12 and defining a cavity therebetween. In this manner, when the stand 20 is in the retracted position the stand 20 is positioned entirely in the cavity. In this embodiment, the cover panel 22 helps to protect the stand 20 and prevent various stored components from being snagged on corners and/or features of the stand 20. However, the cover panel 22 is optional and may be omitted.

Figure 2:
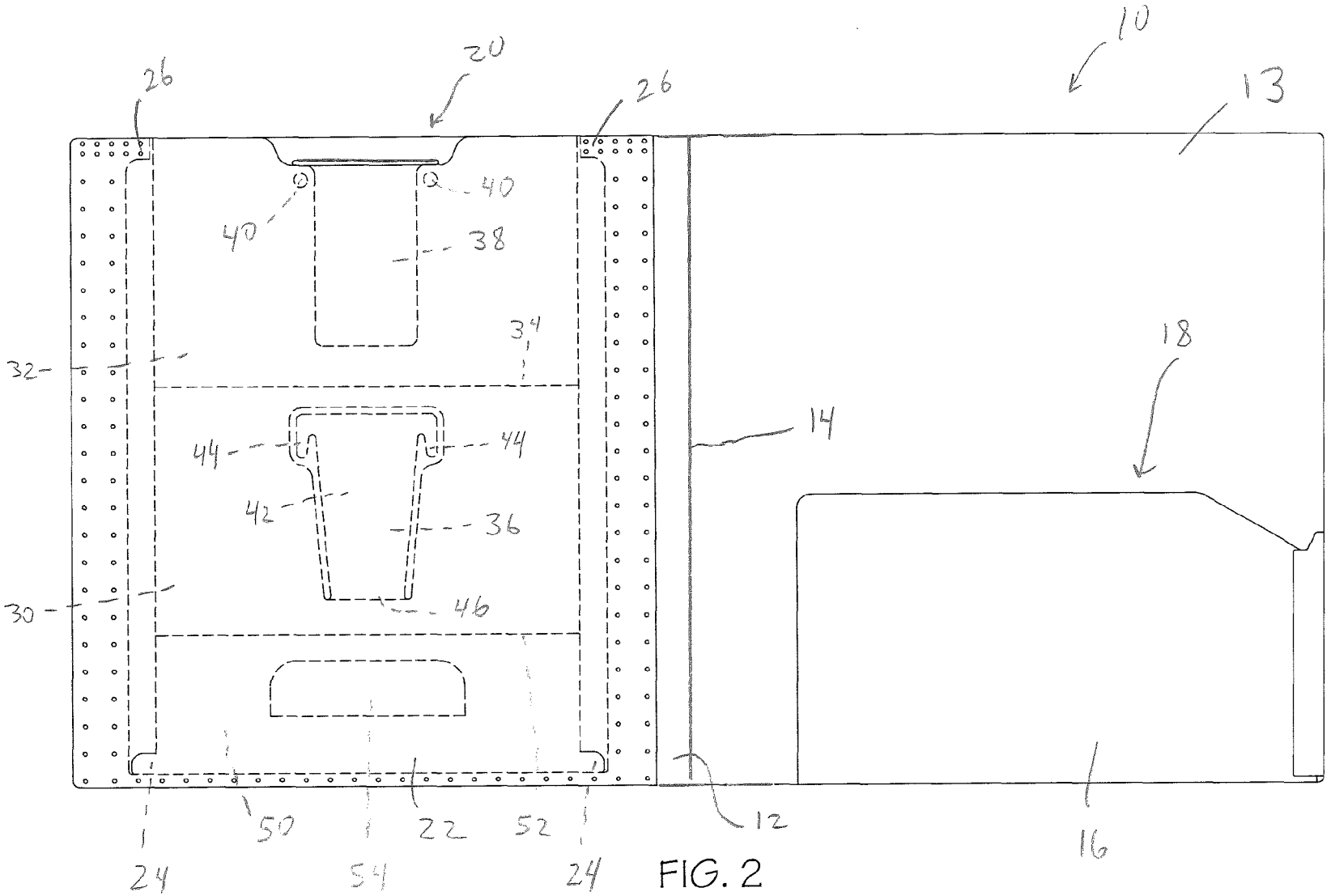
FIG. 2 is a plan view of the component of FIG. 1, shown in its open position.
Figure 3:
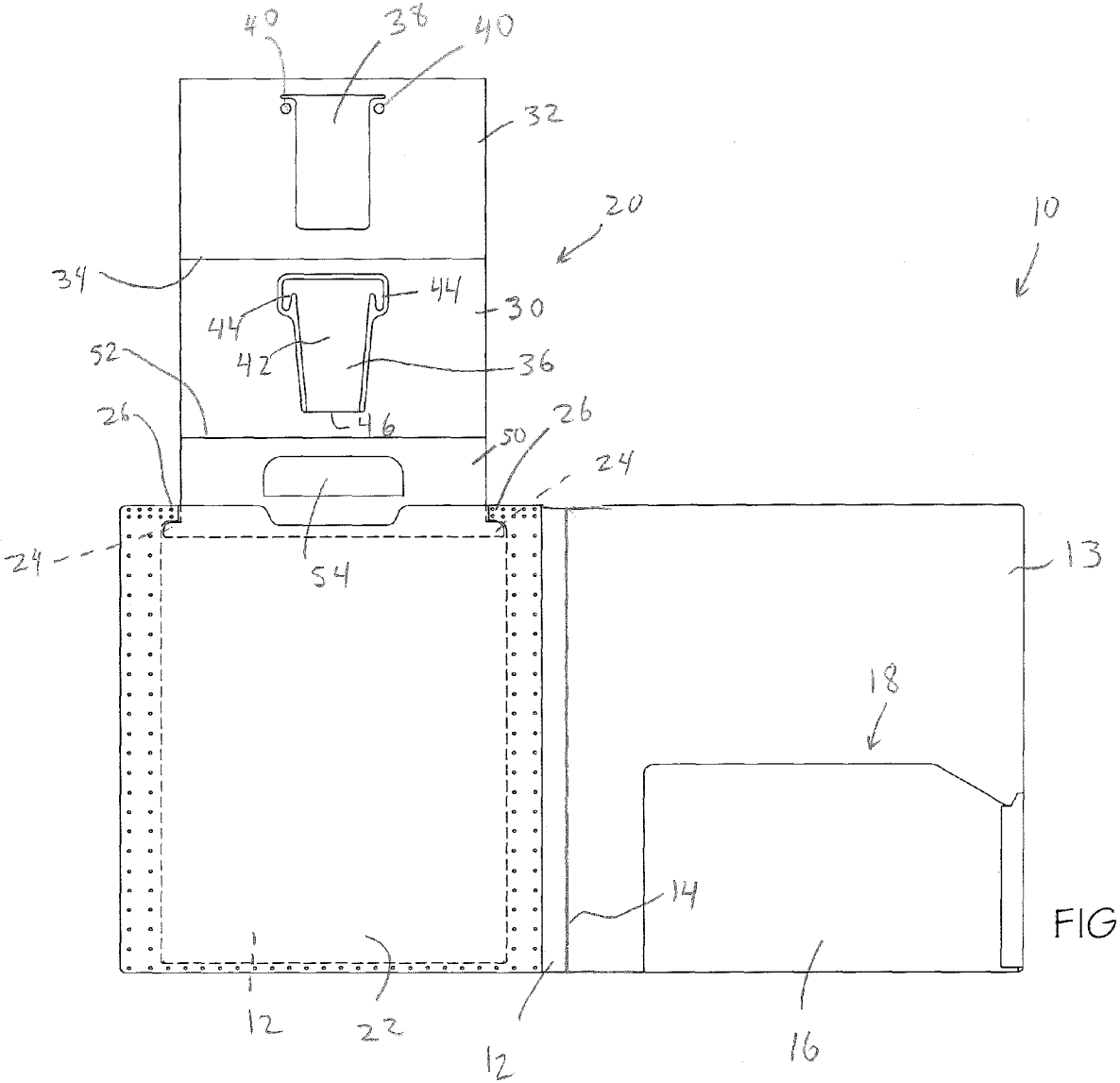
FIG. 3 is a plan view of the component of FIG. 2, with the stand in its extended position.

With reference to FIGS. 2 and 3, in one embodiment the stand 20 includes a pair of opposed, generally laterally outwardly-extending feet 24 at its bottom edge (opposite a mouth of the cavity). The base panel 12 and/or cover panel 22 may include a pair of opposed, generally laterally inwardly-extending feet 26 at the upper end thereof, adjacent to the mouth of the cavity. The feet 24, 26 are configured to engage each other when the stand 20 is fully extended to prevent the stand 20 from being entirely separated from the base panel 12. Of course, various other structures and devices can be used, if desired, to couple the stand 20 to the base panel 12. In addition, the stand 20 can be moveably coupled to the base panel 12 in various other manners besides slidably such as, for example, pivotally.

The stand 20 can include first 30 and second portions 32 pivotally coupled together along a stand fold line or pivot line 34. The stand 20 may also include a support 36 formed in one of the portions (the first portion 30 in the illustrated embodiment) and a support opening 38 and a pair of flange openings 40 formed in the other one of the portions (the second portion 32 in the illustrated embodiment). In the illustrated embodiment, the support 36 is generally "T" shaped, having a base 42 and a pair of opposed flanges 44, and is pivotally coupled to the first portion 30 along a support fold line or pivot line 46. The support opening 38 has a shape somewhat corresponding to the shape of the support 36, and the flange openings 40 are positioned on opposite sides of the support opening 38. In one embodiment, the stand 20 (including the first 30 and second 32 portions and the support 36, and other portions described below) is made of a single, unitary one-piece of material, with the openings 38, 40 formed therein and material around the support 36 removed to define the support 36 and enable the support 36 to move.

The stand 20 is moveable between its flat configuration (FIG. 3) and a propped configuration (FIG. 4) wherein the first 30 and second 32 portions form an angle therebetween, and both portions 30, 32 form an angle with the base panel 12 and/or underlying support surface, such as a tabletop. When in the propped configuration the stand 20 defines a display surface, at least part of which is positioned at an angle relative to the base panel 12/support surface, and in the illustrated embodiment the display surface is defined by the first portion 30. The first 30 and/or second 32 portions may have some bowing or curvature, but can still be able to "form angles" in the manner specified herein. The display surface can also be defined by stop tab 54/edge 34 or a plane established by a back surface of the device 48 resting against the stop tab 54 at its bottom and resting against edge 34.

When the stand 20 is in its propped configuration, the support 36 can be folded downwardly such that the support 36 is generally parallel with the base panel 12/support surface. The flanges 44 of the support 36 are each receivable in a corresponding flange opening 40 to securely but releasably couple the support 36/first portion 30 to the second portion 32 of the stand 20. The support 36 thereby helps to stabilize the stand 20 and ensure the stand 20 remains in its propped configuration, even when supporting weight thereon, as described below.

When the stand 20 is in its propped configuration, the stand 20 can form a generally "A" shape in side view (as can be visualized from FIG. 4), wherein the first portion 30 forms one leg of the "A," the second portion 32 forms another leg of the "A," and the support 36 forms the cross-bar of the "A." In this manner the support 36 can be permanently coupled to the first portion 30 and releasably coupled to the second portion 32. However, it should be understood that the configuration of the stand 20 can be reversed such that the support 36 is permanently coupled to the second portion 32 and releasably attachable to the first portion 30.

Figure 5:
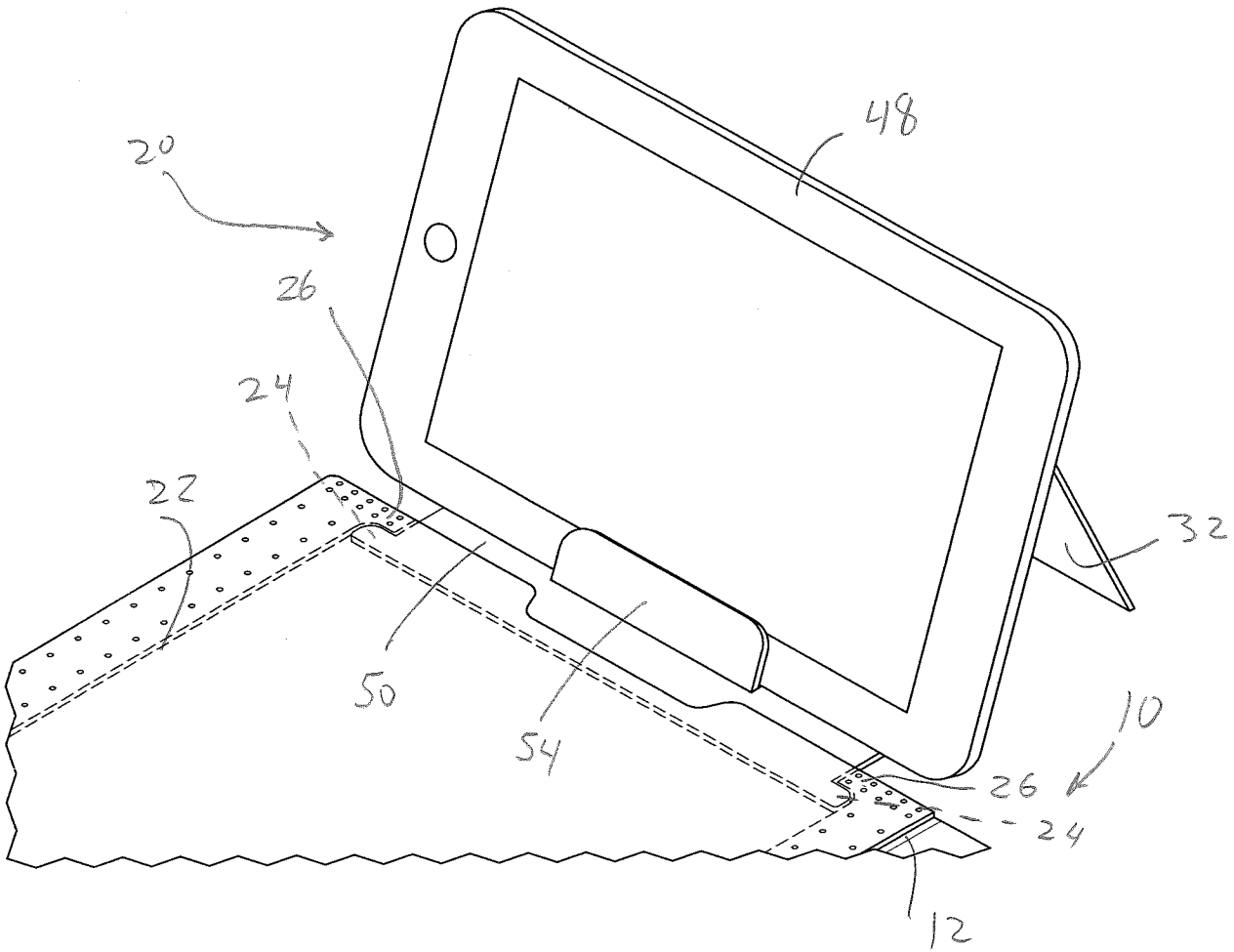
FIG. 5 is a front perspective view of the component of FIG. 4, with an electronic device positioned on the stand.
Figure 6:
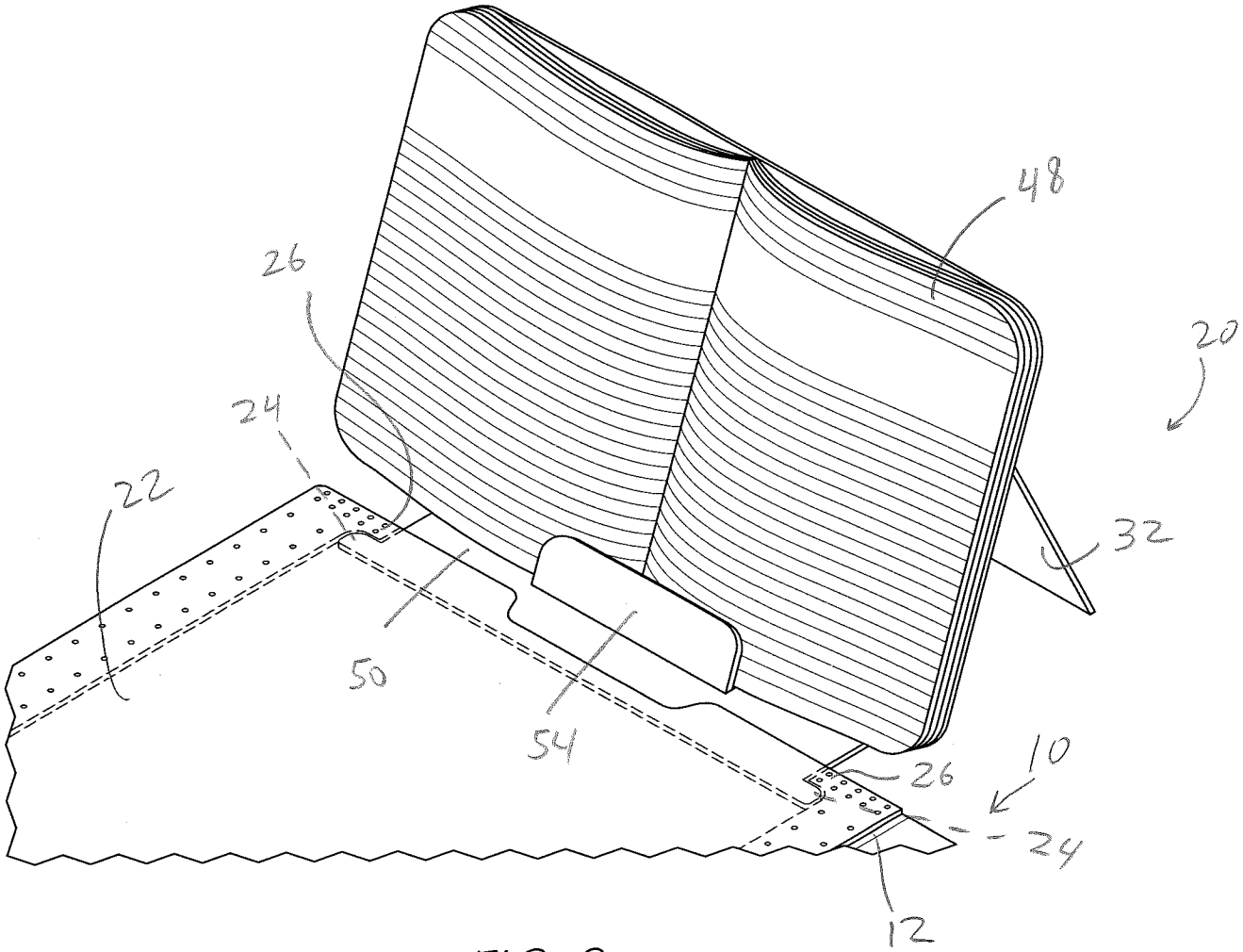
FIG. 6 is a front perspective view of the component of FIG. 4, with a notebook positioned on the stand.

When the stand 20 is in its propped configuration, a device or supplemental component 48, as shown in FIGS. 5 and 6, can be displayed and supported on the stand 20 (in some cases, on the display surface 30) at an angle relative to the base panels 12/support surface, or the like. Any of a wide variety of components 48 can be supported on the stand 20, including, but not limited to electronic tablet devices, notebooks, books, folders, portfolios, binders, pocket binders, mobile phones, etc.

Figure 4:
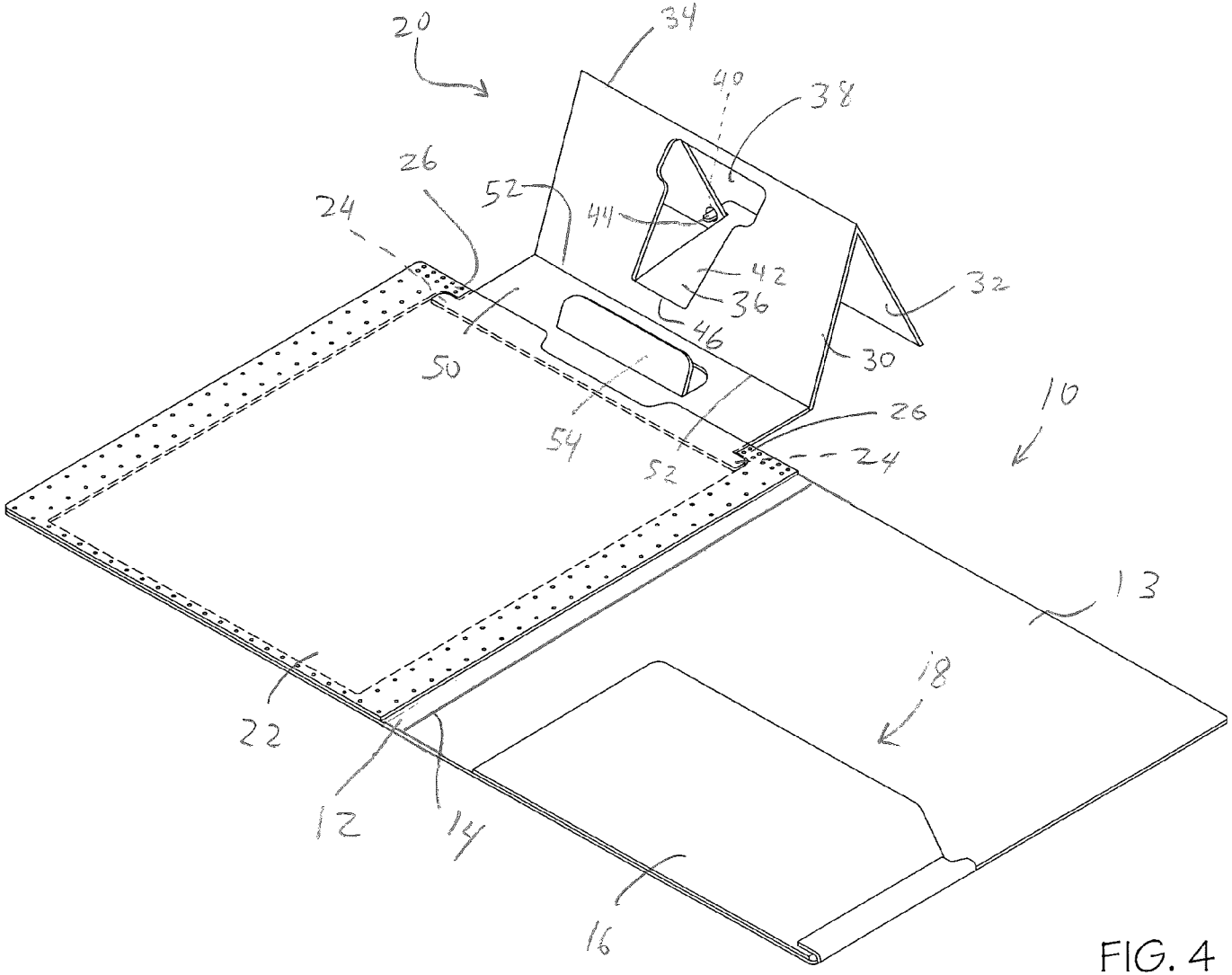
FIG. 4 is a front perspective view of the component of FIG. 3, with the stand in its propped configuration.

In one embodiment, the stand includes a third portion 50 that is pivotally coupled to the first portion 30 along a second stand fold line or pivot line 52. As can be seen in FIGS. 4-6, the third portion 50 remains generally flat and parallel with the base panel 12/support surface when the stand 20 is moved to its propped configuration. The third portion 50 can include a pivotable stop tab 54 formed therein and positioned adjacent to the base panel 12 when the stand 20 is in the propped configuration. The stop tab 54 is configured to thereby extend upwardly and away from the base panel 12 when propped open to receive a lower edge/portion of the propped component 48 thereagainst. In this manner, the stop tab 54 helps to prevent the propped component 48 from sliding away/off of the stand 20.

When it is no longer desired to use the stand 20, the stand 20 can be moved to its flat configuration (FIG. 3), and then moved to its retracted position (FIG. 2). The stand 20 thus folds flat and into the footprint of the base panel 12 for compact storage when not used. The stand 20 thereby provides a convenient, low-profile, reversible device for an external/second component for display. The stand 20 enables a user to, for example, reference one source of material (the component 10 and/or other items stored therein) while writing on or referencing another source of information (the displayed component 48) in close proximity to each other. The stand 20 also elevates or lifts the second component 48 to an angle for easier visual reference for use in presentations or the like.

Having described the invention in detail and by reference to the various embodiments, it should be understood that modifications and variations thereof are possible without departing from the scope of the claims of the present application.

What is claimed is:

1. A component comprising:

a generally flat, planar base panel; and a stand slidably coupled to said base panel, wherein said stand is slidable to an extended position wherein said stand is generally not positioned in, or on or above/below said base panel, said stand including first and second portions pivotally connected together, wherein when said stand is in said extended position said stand is movable to a propped configuration wherein said first and second portions form an angle therebetween to define a display surface, at least part of which is positioned at an angle relative to said base panel.

2. The component of claim 1 wherein said stand is slidable to a retracted position wherein said stand is generally entirely positioned in, or on or above/below said base panel.

3. The component of claim 2 wherein said stand is slidably coupled to said base panel when said stand is in said retracted position.

4. The component of claim 2 wherein said component includes a cover panel, and wherein said stand is configured to be positioned between said base panel and said cover panel when said stand is in said retracted position.

5. The component of claim 2 wherein said component is configured such that said first and second portions are generally co-planar when said stand is in said retracted position.

6. The component of claim 2 wherein said component is configured such that said stand is movable in a translation motion and not in a pivoting motion when moving between the extended position and the retracted position.

7. The component of claim 2 wherein said component is configured such that when said stand is in said retracted position said first and second portions are generally coplanar.

8. The component of claim 1 wherein said stand is positioned adjacent to said base panel, and generally not in, or on or directly above/below said base panel, when said stand is in said extended position.

9. The component of claim 1 wherein said first and second portions are both generally flat and planar.

10. The component of claim 1 wherein said first and second portions are made from a single unitary piece of material.

11. The component of claim 1 wherein said display surface is defined by said first portion.

12. The component of claim 1 wherein said stand is movable to a flat configuration in which said stand is generally flat.

13. The component of claim 12 wherein said stand is positionable in said flat configuration when said stand is in said extended position.

14. The component of claim 12 wherein said first and second portions are generally co-planar when said stand is in said flat configuration and in said retracted position.

15. The component of claim 1 wherein said stand includes a support that is simultaneously attachable to said first and second portions to maintain said stand in said propped configuration.

16. The component of claim 15 wherein said support is configured to be positioned generally parallel to said base panel when attached to said first and second portions.

17. The component of claim 15 wherein said support is permanently coupled to one of said first and second portions and releasably coupled to the other one of said first and second portions.

18. The component of claim 15 wherein when said stand is in said propped configuration said stand has an "A" shape in side view, said first portion forming one leg of said "A," said second portion forming another leg of said "A," and said support forming a cross-bar of said "A".

19. The component of claim 1 wherein said stand includes a third portion pivotally coupled to said first portion, said third portion configured to be positioned generally parallel to and generally co-planar with said base panel when said stand is in said propped configuration.

20. The component of claim 1 wherein said stand includes a stop positioned adjacent to said base panel, said stop being configured, when said stand is in said extended position, to extend away from said base panel to prevent a device positioned on said stand from sliding away therefrom.

21. The component of claim 1 wherein said base panel is pivotally coupled to a supplemental base panel to form a folder, portfolio, notebook, pocket binder or binder.

22. A component comprising:

a generally flat, planar base panel; and a stand coupled to said base panel, wherein said stand is movable between a retracted position wherein said stand is generally entirely positioned in, or on or above/below said base panel and an extended position wherein said stand is generally not positioned in, or on or above/below said base panel, said stand including first and second portions pivotally connected together, wherein when said stand is in said extended position said stand is movable between a generally flat configuration and a propped configuration wherein said first and second portions form an angle therebetween to define a display surface configured to support an item thereon, wherein when said stand is in said retracted position said first and second portions are generally coplanar, and wherein said stand is slidable between said retracted and said extended position.

23. The component of claim 22 wherein said component is configured such that when said stand is in said retracted position said first and second portions are co-planar such that said stand forms an unfolded, single-ply component.

24. The component of claim 22 wherein said component is configured such that when said stand is in said retracted position said stand is entirely directly positioned in, or on or above/below said base panel.

25. A display component comprising:

a generally flat, planar base panel; and a stand translatably movably coupled to said base panel, wherein said stand is translatably movable to an extended position wherein said stand is generally not positioned in, or on or above/below said base panel, wherein when said stand is in said extended position said stand is movable to a propped configuration wherein said stand is defines a display surface configured to support a displayed component thereon at an angle relative to said base panel.

26. The component of claim 25 wherein said stand is slidable between said retracted position and said extended position.

27. The component of claim 25 wherein said stand is translatably movable to a retracted position wherein said stand is generally entirely positioned in, or on or above/below said base panel, said stand including first and second portions pivotally connected together, and wherein said component is configured such wherein when said stand is in said retracted position said first and second portions are generally coplanar.

* * * * *